US011214947B2

(12) United States Patent
Rosko et al.

(10) Patent No.: US 11,214,947 B2
(45) Date of Patent: Jan. 4, 2022

(54) FAUCET SPOUT HAVING AN EXPOSED WATERWAY AND A SUPPLEMENTAL DISCHARGE OUTLET

(71) Applicant: Delta Faucet Company, Indianapolis, IN (US)

(72) Inventors: Michael Scot Rosko, Greenwood, IN (US); Thad J. Eads, Urbana, IN (US)

(73) Assignee: Delta Faucet Company, Indianapolis, IN (US)

( * ) Notice: Subject to any disclaimer, the term of this patent is extended or adjusted under 35 U.S.C. 154(b) by 58 days.

(21) Appl. No.: 16/565,881

(22) Filed: Sep. 10, 2019

(65) Prior Publication Data

US 2020/0087901 A1 Mar. 19, 2020

Related U.S. Application Data

(60) Provisional application No. 62/731,577, filed on Sep. 14, 2018.

(51) Int. Cl.
*E03C 1/04* (2006.01)
*E03C 1/084* (2006.01)

(52) U.S. Cl.
CPC ..... *E03C 1/0404* (2013.01); *E03C 1/084* (2013.01); *E03C 1/0407* (2013.01)

(58) Field of Classification Search
CPC ..... E03C 1/0404; E03C 1/084; E03C 1/0407
USPC ..... 137/801
See application file for complete search history.

(56) References Cited

U.S. PATENT DOCUMENTS 3,726,318 A * 4/1973 Hyde ..... F16K 19/00 137/625.41
10,400,429 B2 9/2019 Eads et al.
2006/0201561 A1* 9/2006 Clift ..... E03C 1/0404 137/801
2010/0187326 A1* 7/2010 Paroonagian ..... E04H 4/14 239/17
2013/0291977 A1* 11/2013 Chung ..... E03C 1/0404 137/801
2017/0081831 A1* 3/2017 Nagayanagi ..... A47K 3/02
2017/0298600 A1 10/2017 Rosko et al.
2018/0298595 A1 10/2018 Eads et al.

FOREIGN PATENT DOCUMENTS

GB 2104625 A * 3/1983 ..... F16K 19/00
WO WO-2016159005 A1 * 10/2016 ..... E04F 15/02
WO WO-2017070232 A1 * 4/2017 ..... E03C 1/0404

* cited by examiner

*Primary Examiner* — Jessica Cahill
*Assistant Examiner* — Patrick C Williams
(74) *Attorney, Agent, or Firm* — Bose McKinney & Evans LLP

(57) ABSTRACT

A faucet spout includes a first discharge outlet that is configured to discharge water therefrom. A water delivery surface is configured to receive water discharged by the first discharge outlet, and the water delivery surface is configured to direct water thereacross. A water delivery edge is configured to receive water directed across the water delivery surface, and the water delivery edge is configured to deliver water thereover. A second discharge outlet is coupled to the first discharge outlet, and the second discharge outlet is configured to discharge water therefrom.

20 Claims, 6 Drawing Sheets

FAUCET SPOUT HAVING AN EXPOSED WATERWAY AND A SUPPLEMENTAL DISCHARGE OUTLET

CROSS-REFERENCE TO RELATED APPLICATION

The present application claims priority to U.S. Provisional Patent Application Ser. No. 62/731,577, filed Sep. 14, 2018, the disclosure of which is expressly incorporated herein by reference.

BACKGROUND AND SUMMARY OF THE DISCLOSURE

The present disclosure relates to faucets spouts having an exposed waterway. More particularly, the present disclosure relates to such faucets including a supplemental discharge outlet for providing a relatively high discharge flow rate.

Aesthetic details are factors considered in the design of faucets. Such details include the shape of faucet components and the shape and/or appearance of water streams discharged from faucets. However, consideration of aesthetic details can adversely affect functional performance of faucets. For example, faucets that provide aesthetically pleasing water streams may deliver water at an undesirably low rate from a functional perspective.

In an illustrative embodiment of the present disclosure, a faucet spout includes a first discharge outlet that is configured to discharge water therefrom. A water delivery surface is configured to receive water discharged by the first discharge outlet, and the water delivery surface is configured to direct water thereacross. A water delivery edge is configured to receive water directed across the water delivery surface, and the water delivery edge is configured to deliver water thereover. A second discharge outlet is coupled to the first discharge outlet, and the second discharge outlet is configured to discharge water therefrom.

In another illustrative embodiment of the present disclosure, a faucet spout includes a first discharge outlet that is configured to discharge water therefrom. An arm is coupled to the first discharge outlet. The arm includes an exposed waterway that is configured to receive water discharged by the first discharge outlet, and the exposed waterway is configured to direct water thereacross. A water delivery edge is configured to receive water directed across the exposed waterway, and the water delivery edge is configured to deliver water thereover. The arm further includes a lower surface opposite the exposed waterway. A second discharge outlet is coupled to the arm and disposed on the lower surface, and the second discharge outlet is configured to discharge water therefrom.

In another illustrative embodiment of the present disclosure, a faucet spout includes an arm portion, and the arm portion includes an upstream end portion, a downstream end portion, and a hydrophilic water delivery surface extending between the upstream end portion and the downstream end portion. A first hydrophobic surface is disposed on a first side of the hydrophilic water delivery surface, and a second hydrophobic surface is disposed on a second side of the hydrophilic water delivery surface. A first discharge outlet is disposed at the upstream end portion, and the first discharge outlet is configured to discharge water therefrom such that the water is directed across the hydrophilic water delivery surface and toward the downstream end portion. A second discharge outlet is disposed at the downstream end portion, and the second discharge outlet is configured to discharge water therefrom.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Figure 1:
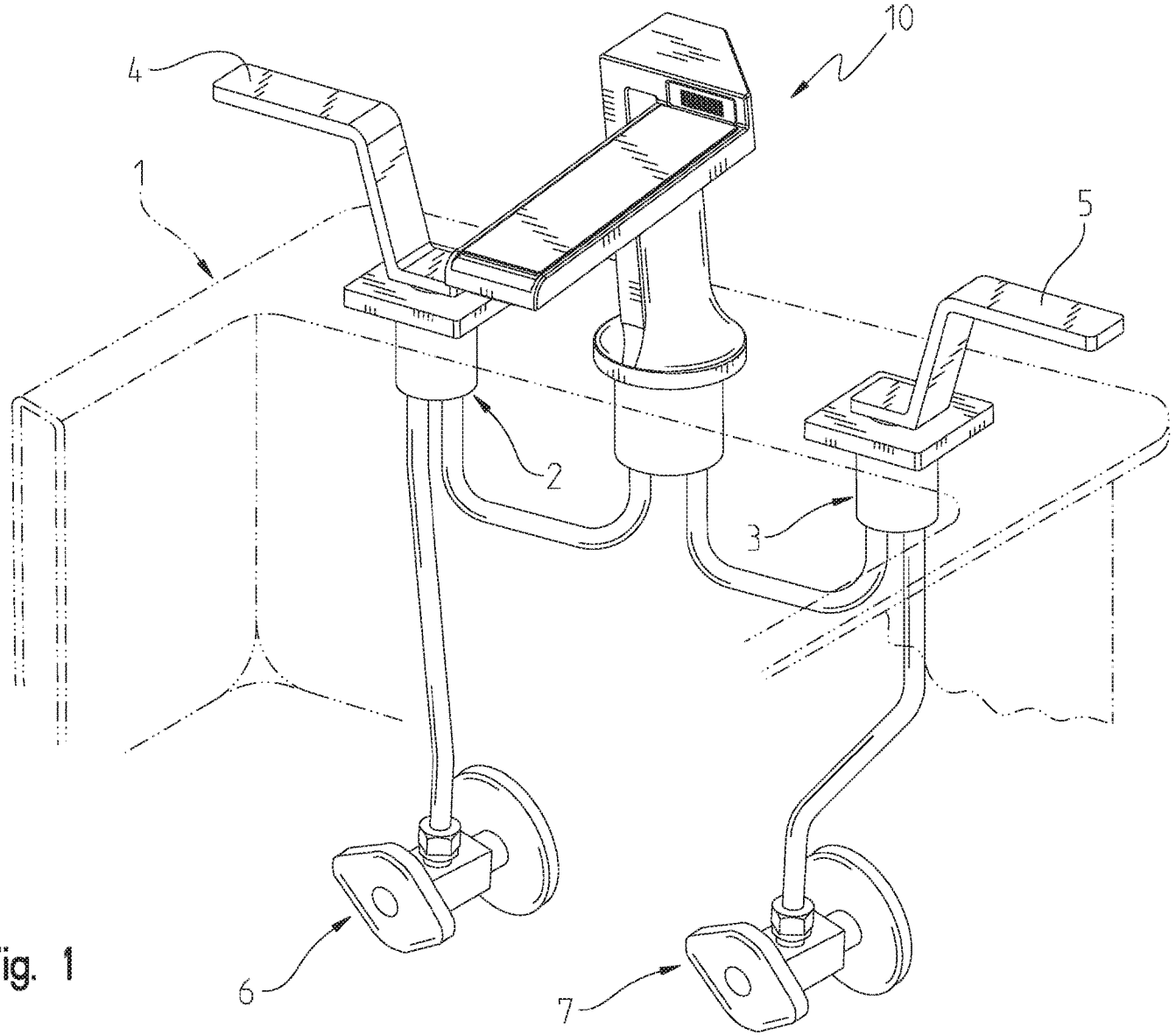
FIG. 1 is a top perspective view of an illustrative faucet or delivery spout of the present disclosure mounted to a sink deck.

Referring initially to FIG. 1, an illustrative faucet or delivery spout 10 is shown coupled to a sink deck 1. In some illustrative embodiments, the faucet spout 10 is in fluid communication with one or more control valves 2 and 3 (for example, hot and cold water control valves) that are selectively actuated by one or more faucet handles 4 and 5 (for example, hot and cold water handles coupled to the hot and cold water control valves, respectively). In one illustrative embodiment, a hot water control valve 2 controls flow of hot water from a hot water source 6 (illustratively, a hot water valve stop) in response to rotation of a hot water handle 4, while a cold water control valve 3 controls flow of cold water from a cold water source 7 (illustratively, a cold water valve stop) in response to rotation of a cold water handle 5. In another illustrative embodiment, a mixing valve (not shown) may control flow of hot water from a hot water source and flow of cold water from a cold water source in response to manipulation of a faucet handle. In some illustrative embodiments, valves may control other types of liquids including, for example, filtered or treated water.

Figure 2:
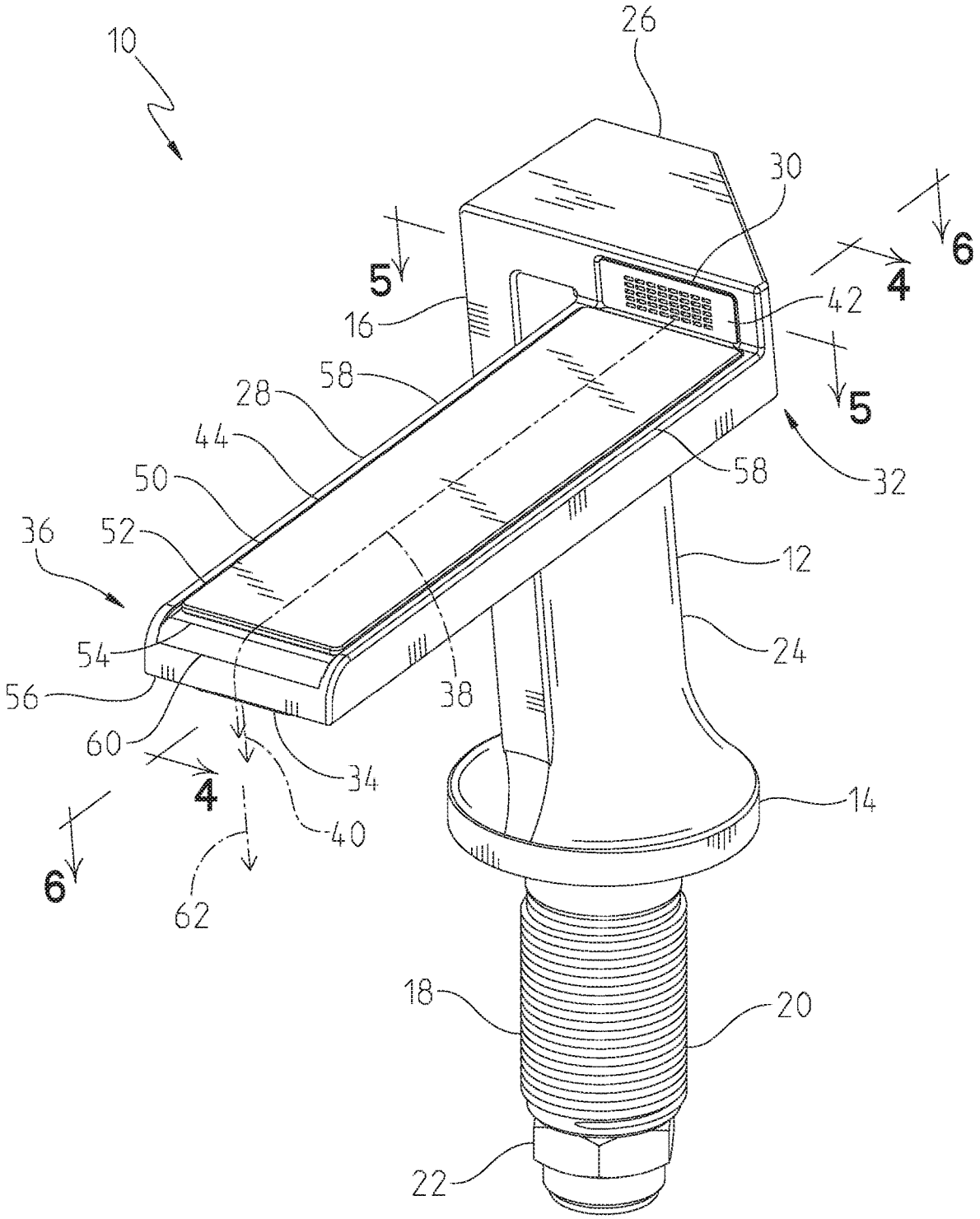
FIG. 2 is a top perspective view of the faucet spout of FIG. 1, including first and second water streams shown in phantom.
Figure 3:
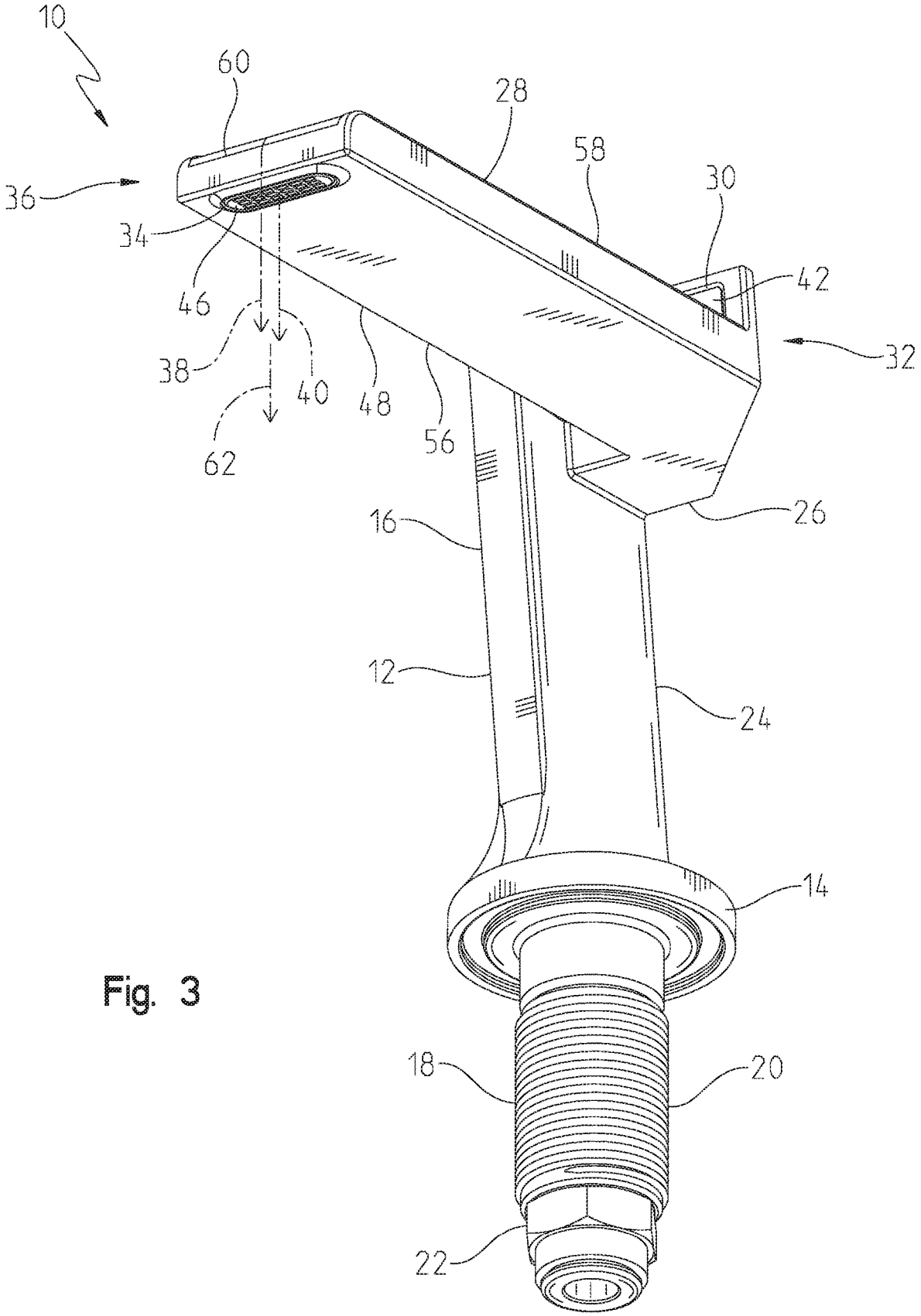
FIG. 3 is a bottom perspective view of the faucet spout of FIG. 1, including the first and second water streams shown in phantom.

Referring now to FIGS. 2 and 3, an illustrative faucet spout 10 is shown. Generally, the faucet spout 10 includes a body 12 having a base 14 and an upwardly extending arm 16. The base 14 couples to a mounting shank 18 (for example, via internal threads—not shown), and the mounting shank 18 is capable of coupling to a mounting nut (not shown), for example, via external threads 20, for securing the faucet spout 10 to a sink deck (not shown). The mounting shank 18 also couples to a fitting 22 (for example, via internal threads—not shown) that is capable of fluid communication with, for example, one or more control valves (not shown), one or more handles (not shown), and one or more valve stops (not shown) of a faucet assembly. Accordingly, the fitting 22 facilitates providing water to the faucet spout 10.

The arm 16 includes a lower arm portion 24, an elbow portion 26 coupled to the lower arm portion 24 opposite the base 14, and an upper arm portion 28 coupled to the elbow portion 26 opposite the lower arm portion 24. The lower arm portion 24, the elbow portion 26, and the upper arm portion 28 are illustratively monolithically formed with each other. The lower arm portion 24 illustratively extends in a generally upward direction. The elbow portion 26 illustratively extends in a generally horizontal direction and substantially perpendicularly from the lower arm portion 24. The upper arm portion 28 illustratively extends at a relatively small angle to the horizontal direction (to facilitate water flow thereacross, as described in further detail below) and substantially perpendicularly from the lower arm portion 24. In alternate embodiments, other arrangements are possible. For example, the elbow portion 26 may be omitted and the lower arm portion 24 may directly couple to the upper arm portion 28. As another example, the lower arm portion 24 and/or the upper arm portion 28 may have different shapes and/or extend in different directions.

Still referring to FIGS. 2 and 3, the arm 16 includes a first or main discharge outlet 30 at an upstream end portion 32 of the upper arm 16 (that is, at the interface between the upper arm portion 28 and the elbow portion 26) and a second or supplemental discharge outlet 34 at a downstream end portion 36 of the upper arm portion 28 (that is, an end opposite the elbow portion 26). The first discharge outlet 30 and the second discharge outlet 34 discharge water transmitted through the arm 16 as a first stream 38 and a second stream 40, respectively. The first discharge outlet 30 includes a first flow device 42, for example, an aerator for providing an aerated stream or a stream straightener for providing a laminar stream. In some embodiments, the flow device 42 may additionally or alternatively include a flow restrictor for limiting the flow rate of water from the first discharge outlet 30. Illustratively, the first discharge outlet 30 discharges the first stream 38 of water in a substantially horizontal direction. Illustratively, the first discharge outlet 30 is disposed above an upper surface 44 of the upper arm portion 28. The second discharge outlet 34 includes a second flow device 46 (see FIG. 3), for example, an aerator for providing an aerated stream or a stream straightener for providing a laminar stream. In some embodiments, the flow device may additionally or alternatively include a flow restrictor for limiting the flow rate of water from the second discharge outlet 34. Illustratively, the second discharge outlet 34 is disposed on a lower surface 48 (see FIG. 3) of the upper arm portion 28 opposite the upper surface 44. Illustratively, the second discharge outlet 34 discharges the second stream 40 of water in a substantially vertical direction.

The first discharge outlet 30 discharges the first stream 38 of water onto an external water delivery surface 50 (see FIG. 2), or an exposed waterway, of the upper arm portion 28, and the water delivery surface 50 directs the first stream 38 of water thereacross. Stated another way, the water delivery surface 50 directs the first stream 38 of water from the upstream end portion 32 to the downstream end portion 36. Illustratively, the water delivery surface 50 is part of a generally elongated and flat upper portion 52 of the upper arm portion 28 that is carried within a channel 54 of a lower portion 56 of the upper arm portion 28. Illustratively, the water delivery surface 50 is disposed at substantially the same height as side walls 58 adjacent to the channel 54 of the lower portion 56. Stated another way, the water delivery surface 50 illustratively defines the upper surface 44 of the upper arm portion 28. The upper portion 52 may include one or more materials and/or the water delivery surface 50 may include a surface finish (for example, one or more coatings and/or surface textures) that facilitates flow of the first stream 38 across the water delivery surface 50 (for example, hydrophilic materials and/or coatings, and/or a relatively smooth texture). The lower portion 56 may include one or more materials and/or the side walls 58 may include a surface finish (for example, one or more coatings and/or surface textures) that inhibits flow of the first stream 38 over the side walls 58 (for example, hydrophobic materials and/or coatings, and/or a relatively rough texture (provided by, for example, laser etching)). In alternate embodiments, the water delivery surface 50 may take other forms. For example, the upper portion 52 may be omitted and the water delivery surface 50 may be formed by the channel 54. As another example, the upper portion 52 and the lower portion 56 may be monolithically formed (or the upper portion 52 may be omitted and the lower portion 56 may lack the channel 54 and include a relatively flat water delivery surface 50), the water delivery surface 50 may include a surface finish (for example, one or more hydrophilic coatings and/or relatively smooth textures) that facilitates flow of the first stream 38 across the water delivery surface 50, and the water delivery surface 50 may be bound on the sides by a surface finish (for example, one or more hydrophobic coatings and/or relatively rough textures) that inhibits flow of the first stream 38 over the sides of the upper arm portion 28. As yet another example, a hydrophilic water delivery surface may be bound on the sides by a first hydrophobic surface and a second hydrophobic surface.

The water delivery surface 50 delivers the first stream 38 of water to a water delivery edge 60 disposed at the downstream end portion 36 of the upper arm portion 28. The water delivery edge 60 delivers the first stream 38 of water thereover, and the first stream 38 of water thereby disengages the faucet spout 10 and is permitted to fall. Illustratively, the water delivery edge 60 has a round or curved shape that facilitates permitting the first stream 38 to move thereover and fall from the faucet spout 10. In some embodiments, the water delivery edge 60 has a radius in a range of 0.75 in. to 0.05 in. In some embodiments, the water delivery edge 60 has a radius of about 0.15 in., about 0.25 in., about 0.35 in., or 0.45 in. In alternate embodiments, the water delivery edge 60 may take other forms. For example, the water delivery edge 60 may have a non-curved shape (that is, the water delivery edge 60 may be a hard edge).

The second discharge outlet 34 discharges the second stream 40 of water therefrom, and the second stream 40 of water of thereby disengages the faucet spout 10 and is permitted to fall. Illustratively, the second discharge outlet 34 discharges the second stream 40 of water at an angle relative to a vertical direction such that the second stream 40 of water joins the first stream 38 of water, thereby forming a common stream 62 of water. In other embodiments, the first stream 38 and the second stream 40 remain separate (that is, the first stream 38 and the second stream 40 do not join to form a common stream 62).

In some embodiments, the faucet spout 10 provides an aesthetically appealing and controlled exposed stream with a relatively low discharge flow rate, but the faucet spout 10 nevertheless includes a relatively high total discharge flow rate. In some embodiments, the first discharge outlet 30 discharges about 25 percent of the water discharged by the faucet spout 10, and the second discharge outlet 34 discharges about 75 percent of the water discharged by the faucet spout 10. In other embodiments, the first discharge outlet 30 and the second discharge outlet 34 discharge different percentages of the water discharged by the faucet spout 10. In some embodiments, the second discharge outlet 34 and the first discharge outlet 30 provide a total discharge flow rate of 1.0 or 1.2 gallons per minute. In other embodiments, the second discharge outlet 34 and the first discharge outlet 30 provide a different total discharge flow rate. In some embodiments, the flow rates of the first stream 38 and the second stream 40 are independently altered to provide the common stream 62 with a different appearance (for example, a more aesthetically pleasing common stream 62).

Figure 4:
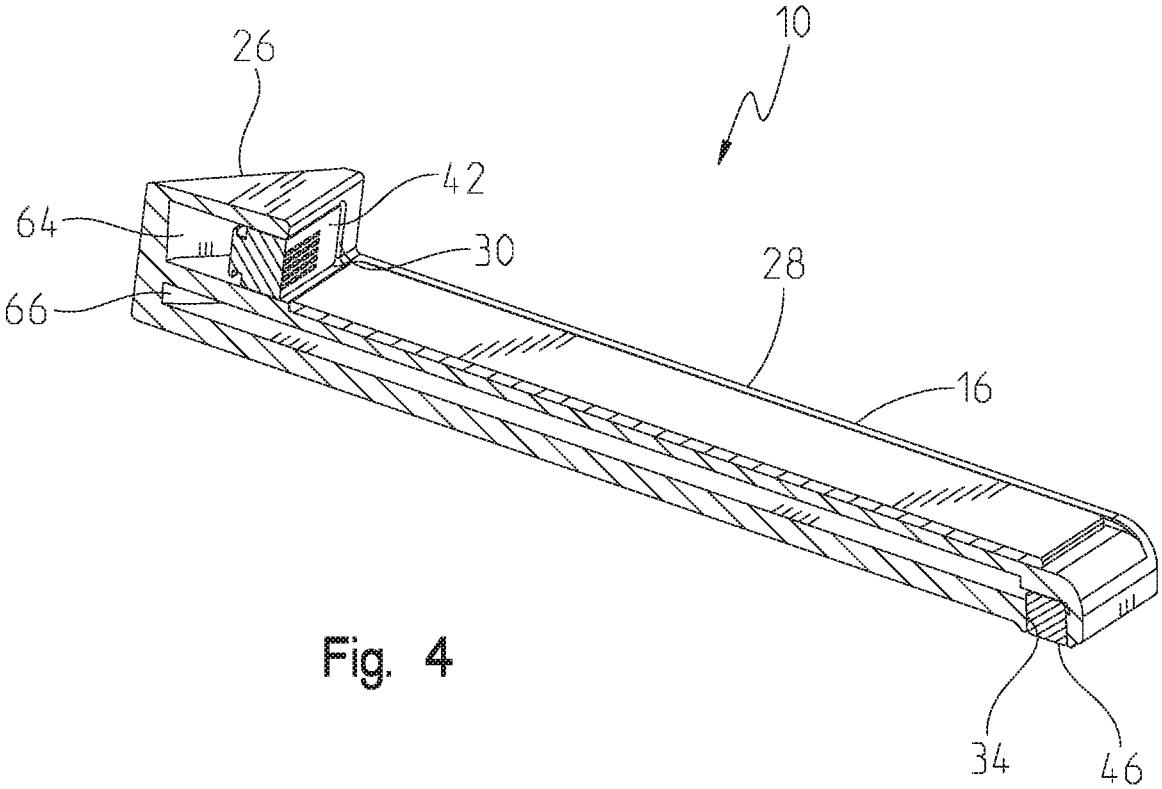
FIG. 4 is a side sectional perspective view of the faucet spout taken along line 4-4 of FIG. 2.

FIG. 4 illustrates a side sectional view of the elbow portion 26 and the upper arm portion 28 of the arm 16. Internally, the arm 16 includes a first outlet passageway portion 64 that is in fluid communication with and delivers water to the first discharge outlet 30. The first outlet passageway portion 64 also carries the first flow device 42. The arm 16 includes a second outlet passageway portion 66 that is in fluid communication with and delivers water to the second discharge outlet 34. The second outlet passageway portion 66 also carries the second flow device 46. As described in further detail below, the first outlet passageway portion 64 and the second outlet passageway portion 66 may be in fluid communication with and receive water from a common passageway or separate passageways.

Figure 5:
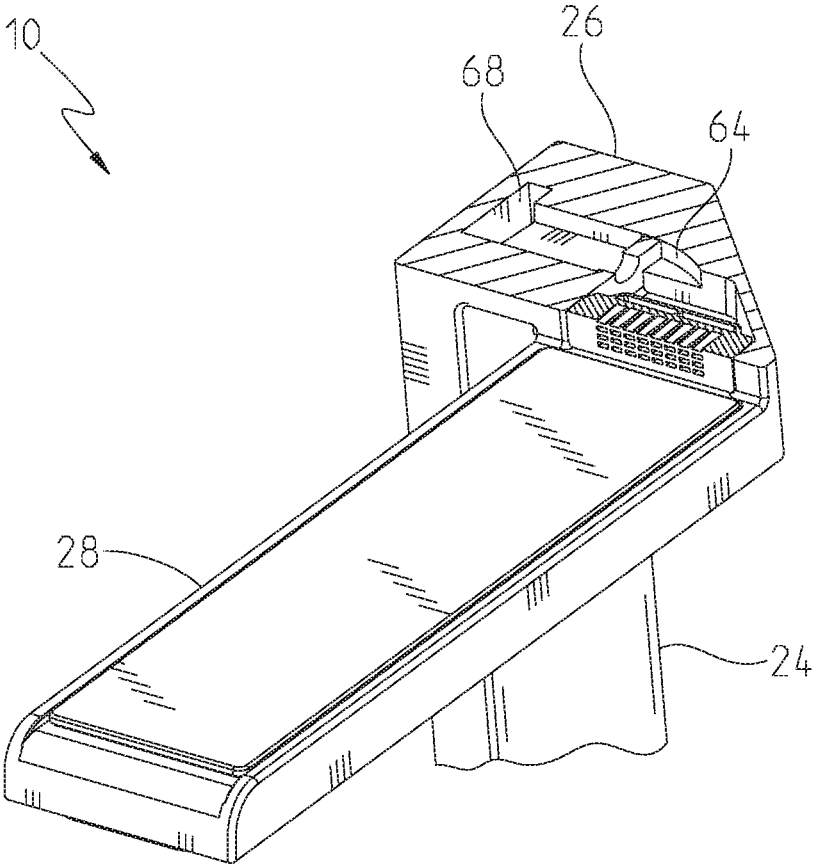
FIG. 5 is a top sectional perspective view of the faucet spout taken along line 5-5 of FIG. 2.
Figure 6:
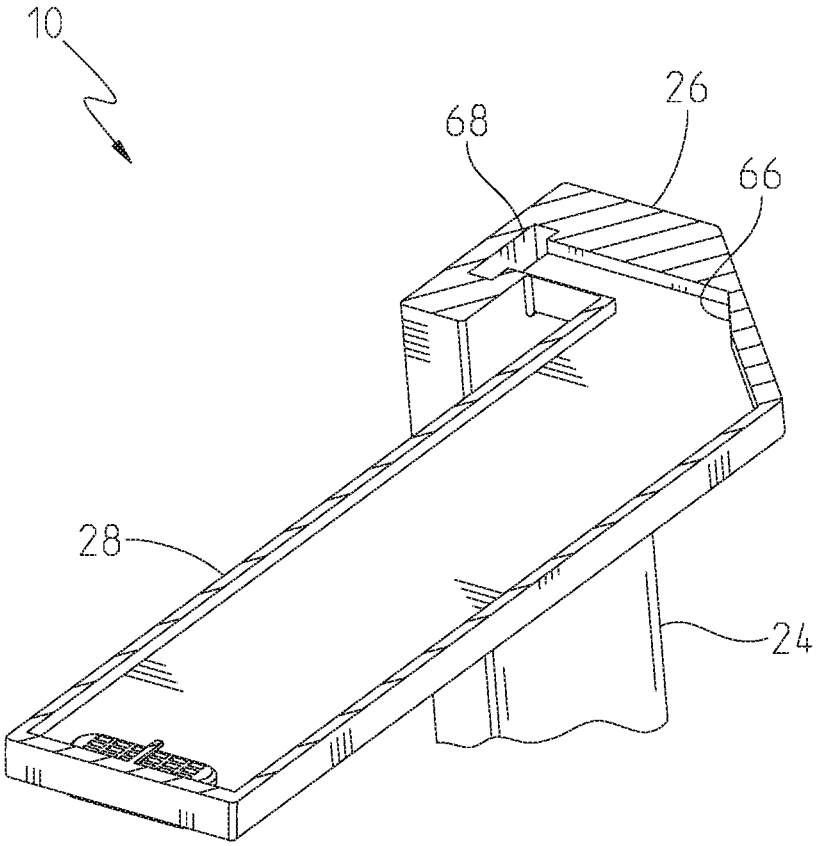
FIG. 6 is a top sectional perspective view of the faucet spout taken along line 6-6 of FIG. 2.

FIGS. 5 and 6 illustrate top sectional views of the elbow portion 26 and the upper arm portion 28 of the arm 16. FIG. 5 illustrates the first outlet passageway portion 64 and an inlet passageway portion 68 that is in fluid communication with and delivers water to the first outlet passageway portion 64. FIG. 6 illustrates the second outlet passageway portion 66 and the inlet passageway portion 68, which is also in fluid communication with and delivers water to the second outlet passageway portion 66. The inlet passageway portion 68 extends through the lower arm portion 24 and the base 14 (see FIGS. 2 and 3) and is in fluid communication with and receives water from the fitting 22 via the adapter 18 (see FIGS. 2 and 3). In alternate embodiments, the passageway portions may take other forms. For example, the first outlet passageway portion 64 and the second outlet passageway portion 66 may be in fluid isolation from each other, and the first outlet passageway portion 64 and the second outlet passageway portion 66 may be in fluid communication with and receive water from separate water sources. As a more specific example, the first outlet passageway portion 64 may receive water from one of a hot water source and a cold water source (and the first discharge outlet 30 may thereby discharge one of hot water and cold water), and the second outlet passageway portion 66 may receive water from the other of the hot water source and the cold water source (and the second discharge outlet 34 may thereby discharge the other of hot water and cold water).

Figure 7:
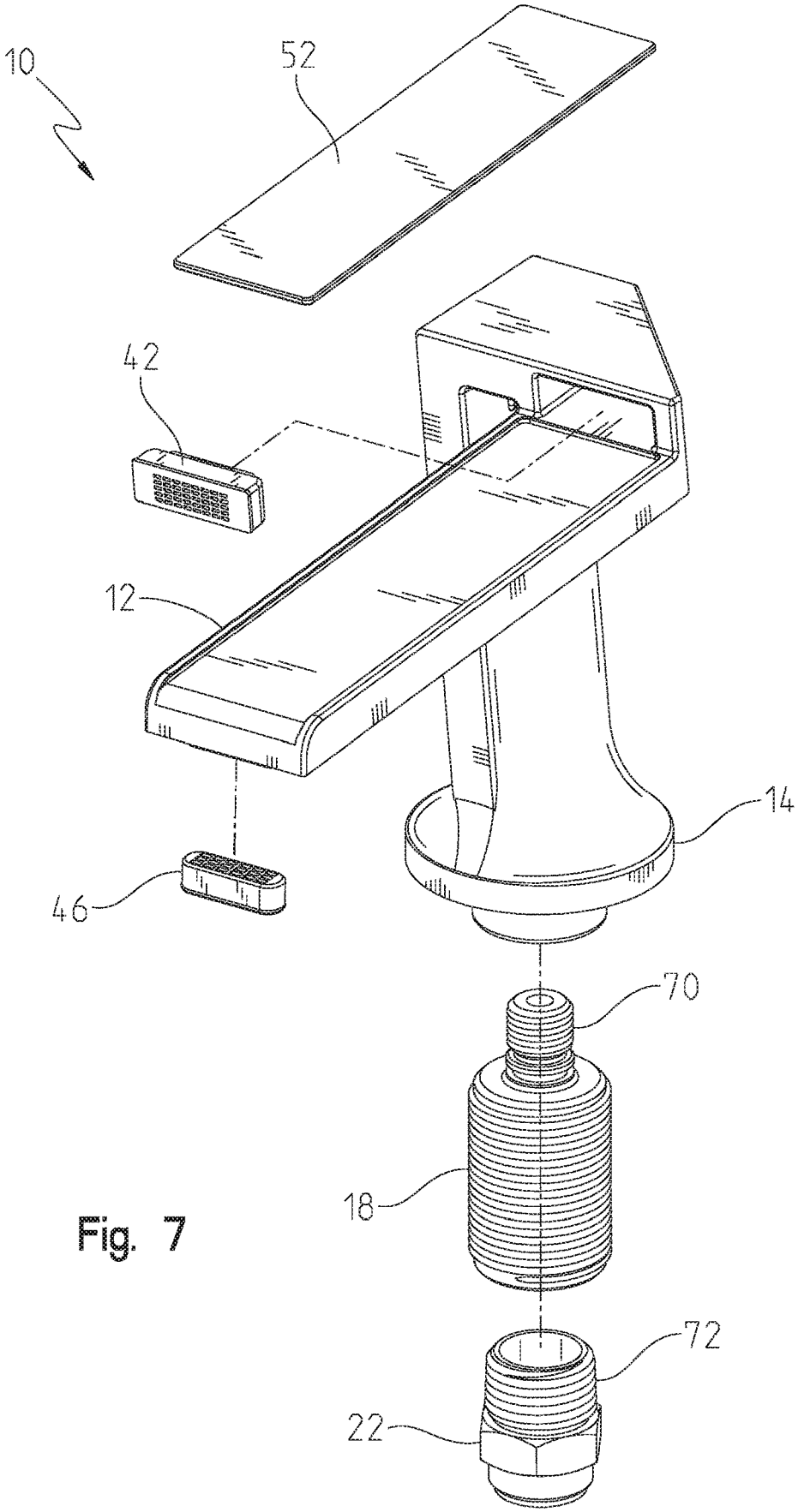
FIG. 7 is an exploded perspective view of the faucet spout of FIG. 1.

FIG. 7 illustrates an exploded perspective view of the faucet spout 10. In FIG. 7, several additional components of the faucet spout 10 are visible. Specifically, the adapter 18 includes an upper external threaded surface 70 that couples to the base 14, and the fitting 22 includes an external threaded surface that couples to the adapter 18.

The illustrative faucet spout 10 may take various other forms. For example, the mounting shank 18 may be omitted, and the base 14 may include an external threaded surface 72 for coupling to a mounting nut (not shown) and securing the faucet spout 10 to a sink deck (not shown).

The faucet spout 10 may comprise various materials, such as metals (for example, stainless steel, such as 316 stainless steel), plastics, combinations thereof (for example, a metal plated polymer), and the like. The faucet spout 10 may be formed using various manufacturing processes. For example, one or more components of the faucet spout 10, including the body 12, may be formed using additive manufacturing processes (for example, desktop fabrication or three dimensional printing), such as selective laser sintering, fused deposition modeling, direct metal laser sintering, electron beam additive manufacturing technology, stereolithography, or the like. In alternate embodiments, one or more components of the faucet spout 10 may be formed using other manufacturing processes, such as casting, molding, machining, combinations thereof, and the like.

Although the invention has been described in detail with reference to certain preferred embodiments, variations and modifications exist within the spirit and scope of the invention as described and defined in the following claims.

What is claimed is:

1. A faucet spout comprising:

a first discharge outlet configured to discharge water therefrom;

a water delivery surface configured to receive a first stream of water discharged by the first discharge outlet, and the water delivery surface being an exposed surface configured to direct the first stream of water thereacross;

a water delivery edge configured to receive the first stream of water directed across the water delivery surface, and the water delivery edge configured to deliver the first stream of water thereover; and a second discharge outlet coupled to the first discharge outlet, the second discharge outlet configured to discharge a second stream of water therefrom wherein the second stream of water is not directed across the water delivery surface to the water delivery edge.

2. The faucet spout of claim 1, wherein the first stream of water and the second stream of water are configured to join and form a common stream of water.

3. The faucet spout of claim 1, further comprising:

a lower arm portion;

an upper arm portion coupled to the lower arm portion, the upper arm portion comprising:

the water delivery surface;

the water delivery edge;

an upstream end portion; and a downstream end portion opposite the upstream end portion;

wherein the water delivery surface extends between the upstream end portion and the downstream end portion of the upper arm portion, and the water delivery edge is disposed at the downstream end portion.

4. The faucet spout of claim 3, wherein the first discharge outlet is disposed at the upstream end portion of the upper arm portion.

5. The faucet spout of claim 3, further comprising an elbow portion coupling the lower arm portion to the upper arm portion.

6. The faucet spout of claim 5, wherein the elbow portion is monolithically formed with the lower arm portion and the upper arm portion.

7. The faucet spout of claim 1, further comprising an arm, wherein the arm comprises a passageway configured to deliver water to the first discharge outlet and the second discharge outlet.

8. The faucet spout of claim 7, wherein the passageway comprises:

an inlet passageway portion;

a first outlet passageway portion in fluid communication with and configured to receive water from the inlet passageway portion, and the first outlet passageway portion in fluid communication with and configured to deliver the first stream of water to the first discharge outlet; and a second outlet passageway portion in fluid communication with and configured to receive water from the inlet passageway portion, and the second outlet passageway portion in fluid communication with and configured to deliver the second stream of water to the second discharge outlet.

9. The faucet spout of claim 1, wherein the first discharge outlet includes a flow device configured to discharge water from the first discharge outlet.

10. The faucet spout of claim 9, wherein the flow device is an aerator.

11. The faucet spout of claim 9, wherein the flow device is a stream straightener.

12. The faucet spout of claim 1, wherein the second discharge outlet includes a flow device configured to discharge water from the second discharge outlet.

13. The faucet spout of claim 12, wherein the flow device is an aerator.

14. The faucet spout of claim 12, wherein the flow device is a stream straightener.

15. The faucet spout of claim 1, wherein the water delivery surface comprises a surface finish configured to facilitate the directing of water across the water delivery surface.

16. A faucet spout comprising:

a first discharge outlet configured to discharge a first stream of water therefrom;

an arm coupled to the first discharge outlet, the arm comprising:

an exposed waterway configured to receive the first stream of water discharged by the first discharge outlet, and the exposed waterway configured to direct the first stream of water thereacross;

a water delivery edge configured to receive the first stream of water directed across the exposed waterway, and the water delivery edge configured to deliver the first stream of water thereover;

a lower surface opposite the exposed waterway; and a second discharge outlet coupled to the arm and disposed on the lower surface, the second discharge outlet configured to discharge a second stream of water therefrom.

17. The faucet spout of claim 16, wherein the exposed waterway defines an upper surface of the arm opposite the lower surface.

18. A faucet spout comprising:

an arm portion comprising:

an upstream end portion;

a downstream end portion;

a hydrophilic water delivery surface extending between the upstream end portion and the downstream end portion;

a first hydrophobic surface disposed on a first side of the hydrophilic water delivery surface;

a second hydrophobic surface disposed on a second side of the hydrophilic water delivery surface;

a first discharge outlet disposed at the upstream end portion, the first discharge outlet configured to discharge a first stream of water therefrom such that the first stream of water is directed across the hydrophilic water delivery surface and toward the downstream end portion wherein at least the downstream end portion of the hydrophilic water delivery surface is an exposed surface; and a second discharge outlet disposed at the downstream end portion, the second discharge outlet configured to discharge a second stream of water therefrom wherein the second stream of water is not directed across the hydrophilic water delivery surface.

19. The faucet spout of claim 18, wherein the arm portion is an upper arm portion, and further comprising a lower arm portion coupled to the upper arm portion.

20. The faucet spout of claim 18, wherein the arm portion further comprises a water delivery edge disposed at the downstream end portion, wherein the water delivery edge is configured to receive water directed across the hydrophilic water delivery surface and deliver water thereover.

* * * * *